US008708457B2

(12) United States Patent
Yamamoto et al.

(10) Patent No.: US 8,708,457 B2
(45) Date of Patent: Apr. 29, 2014

(54) LIQUID EJECTION APPARATUS

(75) Inventors: Shinya Yamamoto, Nagoya (JP); Kiyoshi Sugimoto, Kuwana (JP); Masayuki Okumura, Nagoya (JP); Motohiro Tsuboi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 5 days.

(21) Appl. No.: 13/435,367

(22) Filed: Mar. 30, 2012

(65) Prior Publication Data

US 2013/0027465 A1 Jan. 31, 2013

(30) Foreign Application Priority Data

Jul. 29, 2011 (JP) ..... 2011-167036

(51) Int. Cl.
*B41J 2/165* (2006.01)

(52) U.S. Cl.
USPC ..... 347/34

(58) Field of Classification Search
USPC ..... 347/34
See application file for complete search history.

(56) References Cited

U.S. PATENT DOCUMENTS

2002/0167576 A1 11/2002 Koitabashi et al.
2003/0043230 A1 3/2003 Koitabashi et al.
2006/0181248 A1 8/2006 Aoyama
2011/0242220 A1* 10/2011 Yamagishi et al. ..... 347/47

FOREIGN PATENT DOCUMENTS

JP 2002-154196 A 5/2002
JP 2006-230034 A 8/2006

* cited by examiner

*Primary Examiner* — Justin Seo
(74) *Attorney, Agent, or Firm* — Baker Botts L.L.P.

(57) ABSTRACT

A liquid ejection apparatus includes: a conveyor mechanism conveying a recording medium in a conveying direction; a plurality of liquid ejection heads each having an ejection face from which a liquid is ejected and arranged in the conveying direction; a support member opposed to the ejection face and supporting the recording medium; a first suction mechanism which has a first suction opening located between two of the plurality of liquid ejection heads adjacent to each other in the conveying direction, and which sucks air via the first suction opening; and at least one first contact member located between the two liquid ejection heads in the conveying direction and contactable with a recording face of the recording medium at a position closer to the support member than the first suction opening in a direction perpendicular to the ejection face.

19 Claims, 5 Drawing Sheets

LIQUID EJECTION APPARATUS

CROSS REFERENCE TO RELATED APPLICATION

The present application claims priority from Japanese Patent Application No. 2011-167036, which was filed on Jul. 29, 2011, the disclosure of which is herein incorporated by reference in its entirety.

BACKGROUND OF THE INVENTION

1. Field of the Invention

The present invention relates to a liquid ejection apparatus having a liquid ejection head for ejecting a liquid.

2. Discussion of Related Art

There is known a liquid ejection apparatus in which mist produced by a liquid ejection is moved upward by sucking air between a plurality of heads for ejecting a liquid.

SUMMARY OF THE INVENTION

In a case where an airflow generating means is disposed near the heads, due to the airflow, it is possible that a recording medium rises from a support surface and comes into contact with the head. When the recording medium comes into contact with the head, it is possible that the head is damaged or an image recorded on the recording medium is defective.

It is therefore an object of the present invention to provide a liquid ejection apparatus to restrain a rising of the recording medium.

In order to achieve the above-mentioned object, according to the present invention, there is provided a liquid ejection apparatus comprising: a conveyor mechanism configured to convey a recording medium in a conveying direction; a plurality of liquid ejection heads each of which has an ejection face from which a liquid is ejected and which are arranged in the conveying direction; a support member opposed to the ejection face and configured to support the recording medium; a first suction mechanism having a first suction opening located between two of the plurality of liquid ejection heads adjacent to each other in the conveying direction, the first suction mechanism being configured to suck air via the first suction opening; and at least one first contact member located between the two liquid ejection heads adjacent to each other in the conveying direction and configured to be contactable with a recording face of the recording medium at a position closer to the support member than the first suction opening in a perpendicular direction perpendicular to the ejection face.

BRIEF DESCRIPTION OF THE DRAWINGS

The above and optional objects, features, and advantages of the present invention will be better understood by reading the following detailed description of the embodiments of the invention when considered in conjunction with the accompanying drawings, in which.

DETAILED DESCRIPTION OF THE EMBODIMENTS

Figure 1:
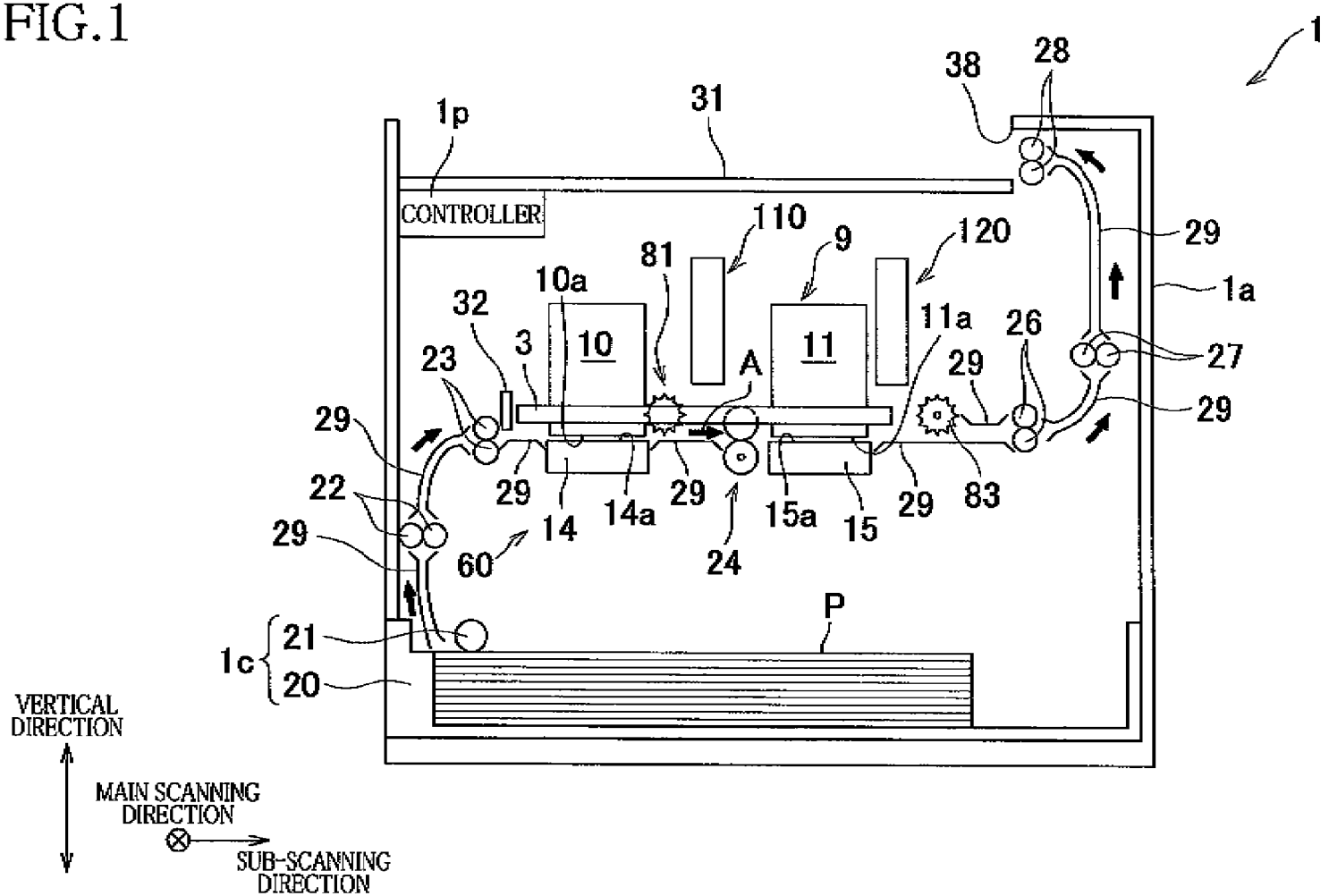
FIG. 1 is a front view schematically showing an internal structure of an inkjet printer as one embodiment to which the present invention is applied.

Hereinafter, there will be described embodiments of the present invention with reference to the drawings. An overall structure of an inkjet printer 1 as one embodiment to which the present invention is applied will be described with reference to FIG. 1.

The inkjet printer 1 includes a casing 1*a* having a rectangular parallelepiped shape. In an upper portion of a top panel of the casing 1*a*, there is provided a sheet-discharge portion 31. In a space defined by the casing 1*a*, there is formed a sheet conveying path through which a recording sheet P as an example of a recording medium is conveyed from a sheet-supply unit 1*c* (described later) to the sheet-discharge portion 31 along a thick arrow A in FIG. 1. In the vicinity of the sheet conveying path, there are disposed a pre-coat head 10 and an inkjet head 11 as examples of liquid ejection heads, a conveyor mechanism 60 for conveying the recording sheet P, and so on.

The pre-coat head 10 is a line-type head having a generally rectangular parallelepiped shape extending in a main scanning direction. To the pre-coat head 10, an image-quality enhancing liquid is supplied from a liquid tank (not shown). A lower face of the pre-coat head 10 is an ejection face 10*a* in which a plurality of nozzles or ejection openings for ejecting the image-quality enhancing liquid are formed. As an example of the image-quality enhancing liquid, a clear and colorless liquid is used so as to coagulate pigment of ink. Materials of the liquid are suitably selected, e.g. a liquid including multivalent metal salt such as cationic polymer and magnesium salt and so forth. When ink lands on an area of the recording sheet P to which the image-quality enhancing liquid is applied in advance, the multivalent metal salt and the like affects on dye or pigment in the ink such that insoluble or hardly-soluble metal complex or the like is coagulated or precipitated. The image-quality enhancing liquid may be a liquid having a function to enhance a color optical density of the ink. The pre-coat head 10 is controlled by the controller 1*p* so as to eject a pre-coat liquid from the nozzles thereof.

Figure 3:
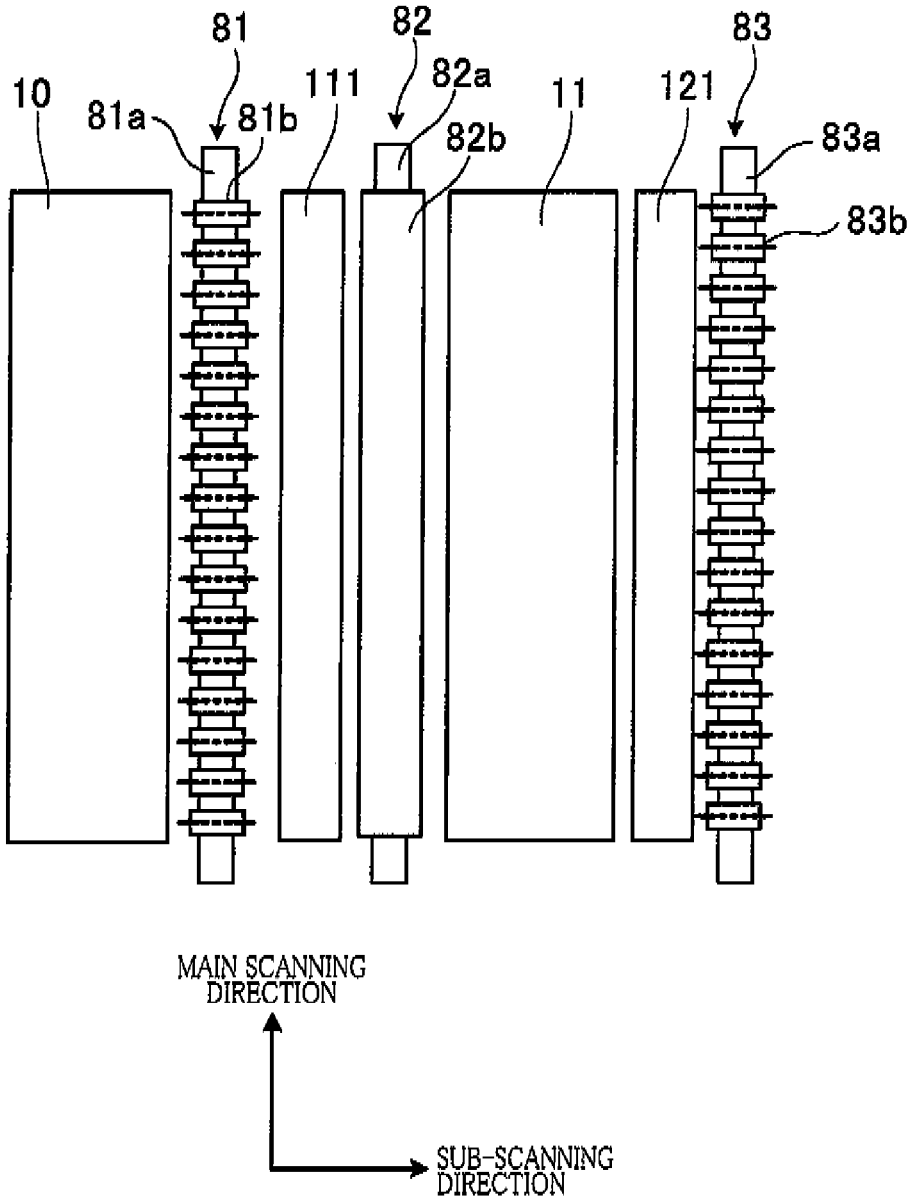
FIG. 3 is a plan view of the inkjet head, a duct, a pair of between-heads rollers and a spur roller.

The inkjet head 11 is a line-type head having the same shape as the pre-coat head 10. The inkjet head 11 is located side by side with the pre-coat head 10 on a downstream side of the pre-coat head 10 in a direction of the arrow A in FIG. 1. As shown in FIG. 3, the inkjet head 11 is also located at the same position as the pre-coat head 10 in a main scanning direction (described later). Black ink is supplied from an ink tank (not shown) to the inkjet head 11. A lower face of the inkjet head 11 is an ejection face 11*a* in which a plurality of nozzles or ejection openings for ejecting the black ink are formed. The ejection face 11*a* is located at the same position as the ejection face 10*a* in a vertical direction. The inkjet head 11 is controlled by the controller 1*p* so as to eject the ink from the nozzles thereof. Hereinafter, in a case where the pre-coat head 10 and the inkjet head 11 are unnecessary to be distinguished from each other, the pre-coat head 10 and the inkjet head 11 can be simply referred to as the head 10 and the head 11.

Platens 14, 15 (as an example of a support member) are located below the respective heads 10, 11. On respective upper faces of the platens 14, 15, there are formed flat support faces 14*a*, 15*a* for supporting the recording sheet P. The support faces 14*a*, 15*a* are located at the same position with each other in the vertical direction. The heads 10, 11 are supported by the casing 1 a via a head holder 3 such that small clearances suitable for an image recording made between the ejection face 10*a* and the support face 14*a* and between the ejection face 11*a* and the support face 15*a*, respectively. The clearance between the ejection face 10*a* and the support face 14*a* and/or the clearance between the ejection face 11*a* and the support face 15*a* form the conveying path. In other words, the conveying path, is a space defined by the ejection face 10*a* and the support face 14*a* and/or by the ejection face 11*a* and the support face 15*a*. The image-quality enhancing liquid is adhered to the recording sheet P by ejection of the image-quality enhancing liquid from the head 10 while the recording sheet is supported on the support face 14*a*. The ink is adhered to the recording sheet P by ejection of the ink from the head 11 while the recording sheet P is supported on the support face 15*a*. Further, a guide 29 is disposed between the platens 14, 15 in a sub-scanning direction. An upper face of the guide 29 is located at the same position as the support faces 14*a*, 15*a* in the vertical direction. A guide 29 is disposed between a spur roller 81 and a driven roller 82 in the sub-scanning direction. At a position opposite to a suction opening 111*b* in the guide 29, there is formed a penetrating hole 29*a*.

The conveyor mechanism 60 includes the sheet-supply unit 1*c*, the guide 29, pairs of feed rollers 22, 26 through 28, a pair of register rollers 23, and a pair of between-heads rollers 24. The conveyor mechanism 60 is controlled by the controller 1*p* to convey the recording sheet P from the sheet-supply unit 1*c* to the sheet-discharge portion 31 along the sheet conveying path.

The sheet-supply unit 1*c* includes a sheet-supply tray 20 and a sheet-supply roller 21. The sheet-supply tray 20 is detachably attached to the casing 1*a* in the sub-scanning direction. The sheet-supply tray 20 has a box-like structure opening upward and can accommodate a plurality of recording sheets P. The sheet-supply roller 21 is rotated by control of a sheet-supply motor 21M (shown in FIG. 4) by the controller 1*p* so as to supply an uppermost one of the plurality of recording sheets P in the sheet-supply tray 20. The recording sheet P supplied by the sheet-supply roller 21 is guided by the guide 29 and fed to the pair of feed rollers 22. The pair of feed rollers 22 are rotated by control of a feed motor 22M (shown in FIG. 4) by the controller 1*p* so as to feed the recording sheet P to the pair of register rollers 23.

The pair of register rollers 23 are rotated by control of a register motor 23M (shown in FIG. 4) by the controller 1*p*. The pair of register rollers 23 nip a front end of the recording sheet P (a downstream end thereof in the sub-scanning direction) fed by the pair of feed rollers 22 without rotation of the pair of register rollers 23 during a predetermined registering period of time. Accordingly, slanting of the front end of the recording sheet P (slanting of the recording sheet P) is corrected in a state in which the front end of the recording sheet P is nipped by the pair of register rollers 23. Amer the registering period of time has elapsed, the pair of register rollers 23 are rotated. Thus, the recording sheet P whose slanting is corrected is fed to the pair of between-heads rollers 24 along the arrow A in FIG. 1. There is provided a sheet sensor 32 between the pair of register rollers 23 and the head 10. The sheet sensor 32 detects whether the recording sheet P has passed below the sheet sensor 32 and outputs a detection signal.

The pair of between-heads rollers 24 are rotated by the control of the feed motor 22M by the controller 1*p*. The pair of between-heads rollers 24 are located between the heads 10, 11 in the sub-scanning direction and have two rollers of a drive roller 25 (as an example of a conveyor roller) and a driven roller 82. The drive roller 25 and the driven roller 82 will be described later. The pair of between-heads rollers 24 nip the recording sheet P fed from the pair of register rollers 23 between the heads 10, 11 and further feed the recording sheet P to the pair of feed rollers 26 along the arrow A in FIG. 1. At this time, the recording sheet P passes through respective positions opposite to the ejection faces 10*a*, 11*a*. The pairs of feed rollers 26, 27 are rotated by the control of the feed motor 22M by the controller 1*p*. The pair of feed rollers 27 further feed the recording sheet P fed along the arrow A in FIG. 1 to the pair of feed rollers 28 along the guide 29. The pair of feed rollers 28 are rotated by the control of the feed motor 22M by the controller 1*p*. The pair of feed rollers 28 feed the recording sheet P to the sheet-discharge portion 31 via an opening 38 formed in an upper portion of the casing 1*a*.

In the present embodiment, the sub-scanning direction is a direction along the arrow A in FIG. 1 and a conveying direction of the recording sheet P positioned at the respective positions opposite to the ejection faces 10*a*, 11*a*. In other words, the sub-scanning direction is a conveying direction. The main scanning direction is a direction in parallel with a horizontal surface and perpendicular to the sub-scanning direction. The head 10 located on a most upstream side in the sub-scanning direction (as an example of a conveying direction) among the heads 10, 11 is an example of a second head and the head 11 adjacent to the head 10 is an example of a first head.

Figure 4:
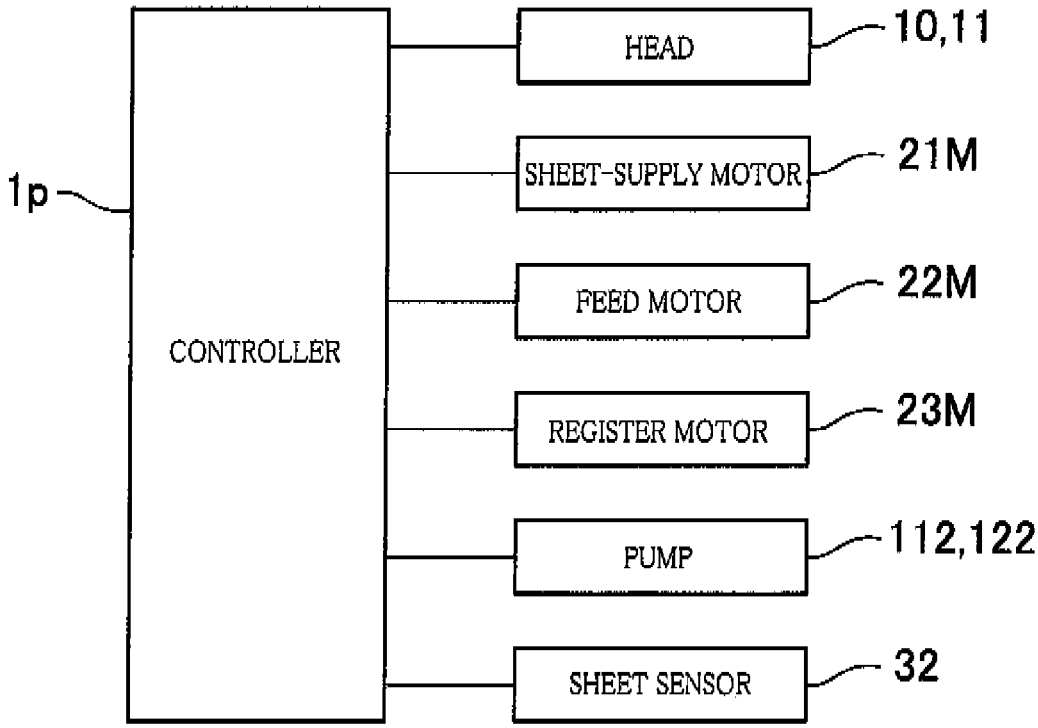
FIG. 4 is a block diagram showing a function of a controller.

As shown in FIG. 4, in the inkjet printer 1, there is accommodated the controller 1*p* for controlling operations of respective portions of the inkjet printer 1. When print data are transmitted from an external device such as a PC to the controller 1*p*, the controller 1*p* controls to convey the recording sheet P based on the print data. The controller 1*p* also controls the heads 10, 11 to eject liquid based on the print data. More precisely, the controller 1*p* controls the sheet-supply motor 21M, the feed motor 22M, and the register motor 23M to convey the recording sheet P from the sheet-supply tray 20 to the sheet-discharge portion 31. When the recording sheet P fed from the sheet-supply tray 20 has reached the sheet sensor 32, the sheet sensor 32 outputs the detection signal. After a predetermined period of time has passed since the sheet sensor 32 outputted the detection signal, the controller 1*p* controls the head 10 or the head 11 to eject the image-quality enhancing liquid or the ink. Here, the predetermined period of time is a period of time obtained for each head 10, 11, by a distance along the conveying path from the front end of the recording sheet P when the sheet sensor 32 has detected the recording sheet P to a most upstream one of the nozzles of each head 10, 11 in the conveying direction, divided by a conveying speed of the recording sheet P. Through a liquid ejection from the heads 10, 11, a desired image is recorded on the recording sheet P based on the print data. The controller 1*p* also controls pumps 112, 122 to suck air from suction openings 111*b*, 121*b*. The pumps 112, 122 will be described later. During conveying of the recording sheet based on the print data, the controller 1*p* controls the pumps 112, 122 to suck air from the suction openings 111*b*, 121*b*.

In the present inkjet printer 1, there are disposed suction mechanisms 110, 120 (as examples of a first suction mechanism and a second suction mechanism) for sucking mists of the image-quality enhancing liquid and the ink produced in the printer 1. When the image-quality enhancing liquid and the ink are ejected from the heads 10, 11, it is possible that a part of those ejected liquid becomes a tiny droplet and floats in the air in an atomized state. In the present embodiment, in a case where the liquids are ejected from the heads 10, 11 toward the recording sheet P such that the image is recorded on the recording sheet P, the recording sheet P is conveyed in a direction of the arrow A. Therefore, in the vicinity of the heads 10, 11, there is produced airflow in the direction of the arrow A with conveying of the recording sheet P. In other words, the mists of the liquids ejected from the heads 10, 11 floating in the air without landing on the recording sheet P move in the direction of the arrow A due to the airflow.

Figure 2:
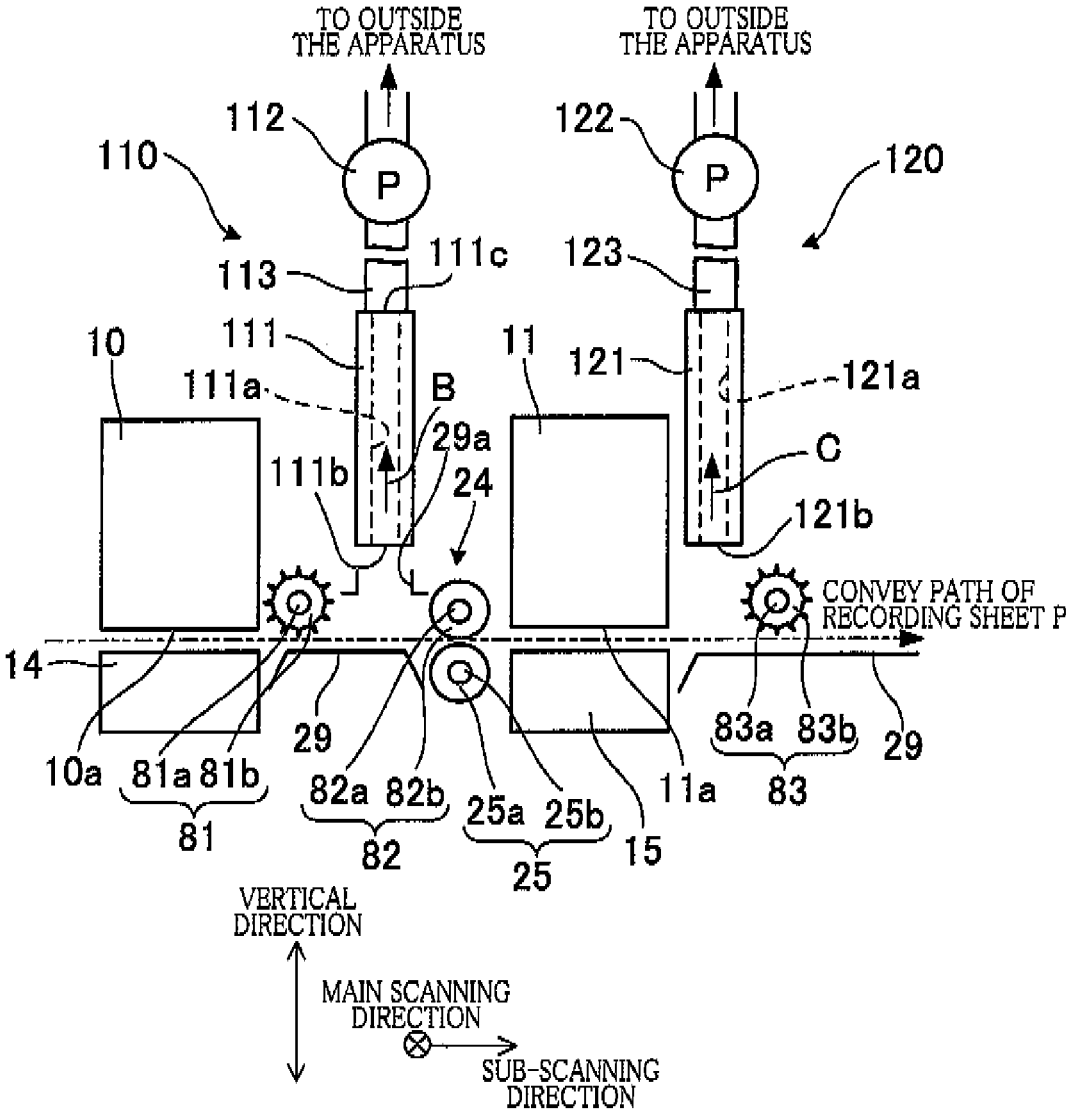
FIG. 2 is a front view showing a peripheral structure of an inkjet head of the inkjet printer.

Hereinafter, a construction of the suction mechanisms 110, 120 and the periphery thereof will be described with reference to FIGS. 1 through 3. The suction mechanism 110 includes a duct 111, the pump 112 and a passage 113. The duct 111 has a generally rectangular shape having the substantially same length as the heads 10, 11 in the main scanning direction. A hollow space 111*a* extending in the vertical direction is formed in the duct 111. On a lower end of the duct 111, there is formed the suction opening 111*b* (as an example of a first suction opening) for sucking air, and on an upper end of the duct 111, there is formed an opening 111*c* of the space 111*a*. The suction opening 111*b* communicates with, the space 111*a* and is located between the heads 10, 11 in the sub-scanning direction and at a position slightly higher than the pair of between-heads rollers 24 in the vertical direction. The suction opening 111*b* is also arranged to be opposed to the penetrating hole 29*a* of the guide 29. Further, the suction opening 111*b* is located at a position higher than the ejection face 10*a* of the head 10 in the vertical direction, i.e., at a position farther from the guide 29 than the ejection face 10*a* in the vertical direction.

The opening 111*c* communicates with the outside of the printer 1. The pump 112 is disposed in a middle of the passage 113. The pump 112 is controlled by the controller 1*p* to suck air in the space 111*a* via the passage 113 and discharge it to the outside of the printer 1. When the pump 112 sucks the air in the space 111*a*, the air in the vicinity of the suction opening 111*b* is sucked into the space 111*a* with the mist, then moved upward in the vertical direction along an arrow B in FIG. 2, and discharged to the outside of the printer 1 via the passage 113. In a case where the mist of the image-quality enhancing liquid ejected from the head 10 is moved in the direction of the arrow A in FIG. 1, because the suction opening 111*b* is located between the heads 10, 11, the mist is sucked to the duct 111 via the suction opening 111*b*. Accordingly, the mist of the image-quality enhancing liquid is restricted from moving toward the head 11. If the image-quality enhancing liquid is adhered to the ejection face 11*a*, it is possible that the ink in the vicinity of the nozzles is coagulated or precipitated so as to close the nozzles, leading to ejection failure or poor ejection. The suction mechanism 110 restricts the mist of the image-quality enhancing liquid from reaching toward the head 11, so that the image-quality enhancing liquid is hardly adhered to the ejection face 11*a* and the ejection failure hardly occurs.

The suction mechanism 120 includes a duct 121, the pump 122 and a passage 123 similarly constructed to respective portions of the suction mechanism 110. The suction opening 121*b* (as an example of a second suction opening) disposed at a lower end of the duct 121 is located in the vicinity of a downstream portion of the head 11 in the sub-scanning direction. Further, the suction opening 121*b* is located at a position higher than the ejection face 11*a* of the head 11 in the vertical direction, i.e., at a position farther from the guide 29 than the ejection face 11*a* in the vertical direction. The pump 122 is controlled by the controller 1*p* to suck the air in a space 121*a*, in the duct 121 via the passage 123. Accordingly, the air in the vicinity of the suction opening 121*b* is sucked into the space 121*a* with the mist, then moved upward in the vertical direction along an arrow C in FIG. 2, and discharged to the outside of the printer 1 via the passage 123. Therefore, the mist of the ink ejected from the head 11 is restrained from moving toward the downstream side in the sub-scanning direction. If the mist of the ink is adhered to members defining the conveying path such as the pair of feed rollers 26 and the guide 29, it is possible that the ink is further transferred to the recording sheet P and contaminates the recording sheet P. The suction mechanism 120 restrains the mist of the ink from contaminating the recording sheet P.

The pump 112 of the suction mechanism 110 is greater in suction power than the pump 122 of the suction mechanism 120. More precisely, an amount of air per unit time sucked from the suction opening 111*b* by the pump 112 is adjusted to be greater than that sucked from the suction opening 121*b* by the pump 122. In other words, the amount of air that flows through the suction opening 111*b* in an airflow produced by the pump 112 (hereinafter, referred to as the amount of air of the suction mechanism 110) is greater than the amount of air that flows through the suction opening 121*b* in an airflow produced by the pump 122 (hereinafter, referred to as the amount of air of the suction mechanism 120). Therefore, the mist of the image-quality enhancing liquid is more effectively restrained from moving toward the head 11.

In a case where the suction mechanisms 110, 120 suck the air, it is possible that the recording sheet P positioned below the suction openings 111*b*, 121*b* rises from the support faces 14*a*, 15*a* and/or the guide 29. Especially a front end portion and a rear end portion (a downstream end portion and an upstream end portion in the sub-scanning direction) of the recording sheet P in the sub-scanning direction are easy to rise, compared to a middle portion of the recording sheet P in the sub-scanning direction. In a case where the recording sheet P rises and contacts the head 10 or the head 11, accuracy of conveying of the recording sheet P is reduced or the ink and the image-quality enhancing liquid adhered to the ejection faces 10*a*, 11*a* is transferred to the recording sheet P, so that a quality of image formed on the recording sheet may be decreased. It is also possible that the heads 10, 11 are damaged.

Accordingly, in the present embodiment, there are disposed three rollers in order to restrain rising of the recording sheet P. The three rollers are located between the suction openings 111*b*, 121*b* and the support faces 14*a*, 15*a* in the vertical direction.

The first roller is the spur roller 81 (as an example of a first rotary member) located between the head 10 and the duct 111 in the sub-scanning direction. The spur roller 81 has a rotary shaft 81*a* extending in the main scanning direction and a plurality of roller portions 81*b* fixed to the rotary shaft 81*a*. The rotary shaft 81*a* extends over the head 10 in the main scanning direction and is rotatably supported by the casing 1*a*. As shown in FIG. 3, the duct 111 extends over the same range as the roller portions 81*b* of the spur roller 81 in the main scanning direction, and the suction opening 111*b* of the duct 111 also extends over the same range as the roller portions 81*b* of the spur roller 81 in the main scanning direction. Further, as shown in FIG. 2, the suction opening 111*b* is located on the downstream side of the roller portions 81*b* in the sub-scanning direction. The plurality of roller portions 81*b* are arranged at certain intervals within the same range as the head 10 in the main scanning direction. The roller portion 81*b* has a generally cylindrical shape and, on an outer circumference thereof, a plurality of projections extending in a radial direction are arranged in a circumferential direction. Each projection has the same dimension measured in the radial direction and a lowermost point of a lowermost one of the plurality of projections in the vertical direction is located at the substantially same position as the conveying path of the recording sheet P in the vertical direction. In other words, a lower end of the roller portion 81*b* is located at a position closer to the guide 29 than the ejection face 10*a* of the head 10 in the vertical direction. In a case where the recording sheet P is about to rise, the recording sheet P contacts the projections of the spur roller 81 and the spur roller 81 is rotated by a movement of the recording sheet P. In other words, the spur roller 81 is opposed to a recording face of the recording sheet P (one of opposite faces of the recording sheet P opposed to the ejection faces 10*a*, 11*a*). Therefore, when the spur roller 81 and the recording sheet P come into contact with each other, the spur roller 81 contacts the recording face of the recording sheet P. Since the spur roller 81 has the plurality of projections on an outer circumference thereof so as to make a point contact with the recording face of the recording sheet P, the image-quality enhancing liquid ejected to the recording sheet P is restrained from being defective. Because the spur roller 81 has the plurality of roller portions 81*b* arranged at the certain intervals in the main scanning direction, a plurality of clearances among the plurality of roller portions 81*b* are made in the main scanning direction. The mist of the image-quality enhancing liquid ejected from the head 10 can pass through the above-mentioned clearances and be moved in the direction of the arrow A in FIG. 1.

The second roller of the three rollers is the driven roller 82 (as an example of the first rotary member) as one of two rollers forming the pair of between-heads rollers 24 which contacts the recording sheet P from upward. The driven roller 82 nips the recording sheet P together with the drive roller 25 as the other of the two rollers which contacts the recording sheet P from downward and is driven with the movement of the recording sheet P. The driven roller 25 has a rotary shaft 82*a* extending in the main scanning direction and a roller portion 82*b* fixed to the rotary shaft 82*a*. The rotary shaft 82*a* extends over the head 10 in the main scanning direction and is rotatably supported by the casing 1*a*. The roller portion 82*b* has a generally cylindrical shape having the substantially same length as the head 10 in the main scanning direction. The roller portion 82*b* has a smooth surface with no projections. A lowermost point of the driven roller 82 in the vertical direction is located at the generally same position as the conveying path of the recording sheet P in the vertical direction. A fluorine coating is made on an outer circumferential surface of the roller portion 82*b*. Therefore, when the driven roller 82 and the recording face of the recording sheet P come into contact with each other, the image-quality enhancing liquid ejected to the recording sheet P is restrained from being adhered to the roller portion 82*b* of the driven roller 82.

The drive roller 25 is located at a position opposite to the driven roller 82 in the vertical direction. The drive roller 25 is rotated by a drive of the feed motor 22M by the controller 1*p*. By a rotation of the drive roller 25, the recording sheet P nipped by the drive roller 25 and the driven roller 82 is fed in the direction of the arrow A in FIG. 1. The drive roller 25 has a rotary shaft 25*b* extending in the main scanning direction and a roller portion 25*a* fixed to the rotary shaft 25*b*. The rotary shaft 25*b* extends over the head 10 in the main scanning direction and is rotatably supported by the casing 1*a*. The roller portion 25*a* has a generally cylindrical shape having the substantially same length as the head 10 in the main scanning direction. The roller portion 25*a* is formed of rubber. The driven roller 82 and the drive roller 25 are located between the duct 111 and the head 11 in the sub-scanning direction.

The third roller of the three rollers is a spur roller 83 (as an example of a second rotary member) located in the vicinity of the downstream portion of the duct 121 in the sub-scanning direction. The spur roller 82 consists of a rotary shaft 83*a* and a plurality of roller portions 83*b* having the similar structure as the rotary shaft 81*a* and the roller portions 81*b*. As shown in FIG. 3, the duct 121 extends over the same range as the roller portions 83*b* of the spur roller 83 in the main scanning direction, and the suction opening 121*b* also extends over the same range as the roller portions 83*b* of the spur roller 83 in the main scanning direction. Further, as shown in FIG. 2, the suction opening 121*b* is located on the upstream side of the roller portions 83*b* in the sub-scanning direction. In other words, a lower end of the roller portion 836 is located at a position closer to the guide 29 than the ejection face 11*a* of the head 11 in the vertical direction. The rotary shaft 83*a* is rotatably supported by the casing 1*a*. A lowermost point of a lowermost one of a plurality of projections formed in the roller portion 83*b* is located at the substantially same position as the conveying path of the recording sheet P in the vertical direction. In a case where the recording sheet P is about to rise, the projections of the spur roller 83 contacts the recording sheet P and the spur roller 83 is rotated by the movement of the recording sheet P. In other words, the spur roller 83 is opposed to the recording face of the recording sheet P (one of opposite faces of the recording sheet P opposed to the ejection faces 10*a*, 11*a*). Therefore, when the spur roller 83 contacts the recording sheet P, the spur roller 83 contacts the recording face of the recording sheet P. Since the spur roller 83 has the plurality of projections on an outer circumference thereof so as to make a point contact with the recording face of the recording sheet P, the ink ejected to the recording sheet P is restrained from being defective.

In the present embodiment, in a case where the recording sheet P is about to rise due to sucking of air by the suction mechanism 110, the spur roller 81 and the driven roller 82 prevents the rising of the recording sheet P. When the recording sheet P is fed in the direction of the arrow A, the front end of the recording sheet P first reaches below the spur roller 81 and then reaches below the suction opening 111*b*. Therefore, when the front end portion of the recording sheet P is about to rise due to the suction by the suction mechanism 110, the recording sheet P is restrained from rising by the spur roller 81, so that the rising of the recording sheet P is surely restrained. In other words, because the spur roller 81 is located on the upstream side of the suction opening 111*b* in the sub-scanning direction, the rising of the recording sheet P can be surely restrained. Further, on the downstream side of the suction opening 111*b* in the sub-scanning direction, the driven roller 82 restrains the rising of the recording sheet P. The rising of the recording sheet P is thus restrained both on the upstream side and the downstream side of the suction opening 111*b* in the sub-scanning direction, so that the recording sheet P is restrained from contacting the ejection faces 10*a*, 11*a*.

Further, the guide 29 is located between the platens 14, 15, and the pair of between-heads rollers 24 are located on the downstream side of the suction opening 111*b* in the sub-scanning direction. The pair of between-heads rollers 24 makes the conveying path of the recording sheet P narrow sharply. Thus, an airflow going to the downstream side along the conveying path collides with the pair of between-heads rollers 24 and tends to change its direction to the vertical direction. In other words, the airflow heading for the downstream side along the conveying path tends to become an airflow in the vertical direction via the penetrating hole 29*a*. Because the suction opening 111*b* is located above the penetrating hole 29*a*, the airflow going upward through the penetrating hole 29*a* is smoothly guided into the suction opening 111*b*. Accordingly, the suction mechanism 110 can effectively suck the air.

In a case where the recording sheet P is about to rise due to sucking of air by the suction mechanism 120, the spur roller 83 located on the downstream side of the suction mechanism 120 in the sub-scanning direction prevents the rising of the recording sheet P. Therefore, it is restrained that the recording sheet P rises to contact the head 11.

In a case where the mists produced from the heads 10, 11 are sucked by the suction mechanisms 110, 120 as in the present embodiment, it is preferable that the suction openings 111*b*, 121*b* are respectively located right on the downstream sides of the heads 10, 11 in the sub-scanning direction. Further, in order to suck the mists produced from the heads 10, 11, it is preferable that the amount of air of each of the suction mechanisms 110, 120 is large. However, if the amount of air of each of the suction mechanisms 110, 120 is large, it is possible that the recording sheet P easily rises so as to contact the ejection faces 10*a*, 11*a*.

In the present embodiment, the head 10 is a head which ejects the image-quality enhancing liquid. If the image-quality enhancing liquid is adhered to the ejection face 11*a* of the head 11, it is possible that the ink in the vicinity of the ejection openings is coagulated or precipitated so as to close the ejection openings. In a case where the ejection openings are closed, it is possible that the ejection failure occurs. Therefore, in order to suck the mist of the image-quality enhancing liquid ejected from the head 10, the amount of air of the suction mechanism 110 is determined to be relatively large. Further, since the spur roller 81 and the driven roller 82 are disposed on the upstream side and the downstream side of the suction opening 111*b* in the sub-scanning direction, the rising of the recording sheet P is restrained. Because the amount of air of the suction mechanism 110 is relatively large, it is possible that the recording sheet P rises and the image-quality enhancing liquid is adhered to the spur roller 81 and the driven roller 82 located near the suction opening 111*b*. However, because the image-quality enhancing liquid is clear and colorless, even if the image-quality enhancing liquid is adhered to the spur roller 81 and so on and further transferred to the recording sheet P, it hardly causes that the recording sheet P is directly contaminated. Therefore, as in the present embodiment, it is preferable to effectively restrain the rising of the recording sheet P by such structure that the suction mechanism 110 suck the mist with the large amount of air and also the spur roller 81 and the driven roller 82 are located on the upstream and the downstream sides of the suction opening 111*b* in the sub-scanning direction.

Furthermore, in the present embodiment, the head 11 is a head located on the most downstream side among the heads 10, 11 in the sub-scanning direction. The mist is moved in the direction of the arrow A in FIG. 1 due to the airflow produced by conveying of the recording sheet P. Accordingly, there is little possibility that the mist of the ink ejected from the head 11 affects the other head. The head 11 is a head which ejects ink. In a case where another head for ejecting ink is disposed on the downstream side of the head 11 in the sub-scanning direction, even if the mist of the ink ejected from the head 11 is adhered to an ejection face of the head on the downstream side of the head 11, nozzles or ejection openings of the head on the downstream side of the head 11 are not closed. In other words, the mist of the ink ejected from the head 11 hardly causes the ejection failure, compared to the mist of the image-quality enhancing liquid ejected from the head 10. Therefore, the amount of air of the suction mechanism 120 is determined to be smaller or lower than that of the suction mechanism 110. However, since the head 11 is a head for ejecting ink, in a case where the ink is adhered to a roller and the like, the ink is transferred to the recording sheet P, easily causing to directly contaminating the recording sheet P. Thus, the suction opening 121*b* is located right on the downstream side of the head 11 in the sub-scanning direction, so that the mist of the ink ejected from the head 11 can be effectively collected, even though the amount of air of the suction mechanism 120 is relatively small. Since the amount of air of the suction mechanism 120 is relatively small, even if no spur roller is disposed between the head 11 and the suction opening 121*b*, the spur roller 83 located on the downstream side of the suction opening 121*b* in the sub-scanning direction adequately restrains the rising of the recording sheet P.

Furthermore, as mentioned before, the respective lowest points of the spur roller 81, the driven roller 82 and the spur roller 83 in the vertical direction are located between the suction openings 111*b*, 121*b* and the support faces 14*a*, 15*a* in the vertical direction. In other words, those lowest points of the rollers 81, 82, 83 are closer to the conveying path of the recording sheet P in the vertical direction than the suction openings 111*b*, 121*b*. Accordingly, when the recording sheet P is about to rise, the rollers 81, 82, 83 surely contacts the recording sheet P so as to restrain the rising of the recording sheet P. In a case where the spur roller 81, the driven roller 82 and the spur roller 83 are not disposed, the guide opposite to the recording face of the recording sheet P and the recording sheet P come into contact with each other. In this case, the image-quality enhancing liquid and the ink adhered to the recording sheet P are adhered to the guide 29, so that it is possible that an image of the recording sheet P is defective and the following recording sheet P fed after the above-mentioned recording sheet P having contacted the guide 29 is contaminated. Since the spur rollers 81, 83 have the plurality of projections on the outer circumferences thereof so as to make a point contact with the recording face of the recording sheet P, it can be restrained that liquid is adhered to the spur rollers 81, 83. Moreover, since the fluorine coating is made on the outer circumferential surface of the driven roller 82, it can be restrained that liquid is adhered to the driven roller 82.

The present invention is not limited to the illustrated embodiment. It is to be understood that the present invention may be embodied with various changes and modifications that may occur to a person skilled in the art, without departing from the spirit and scope of the invention defined in the appended claims.

Figure 5:
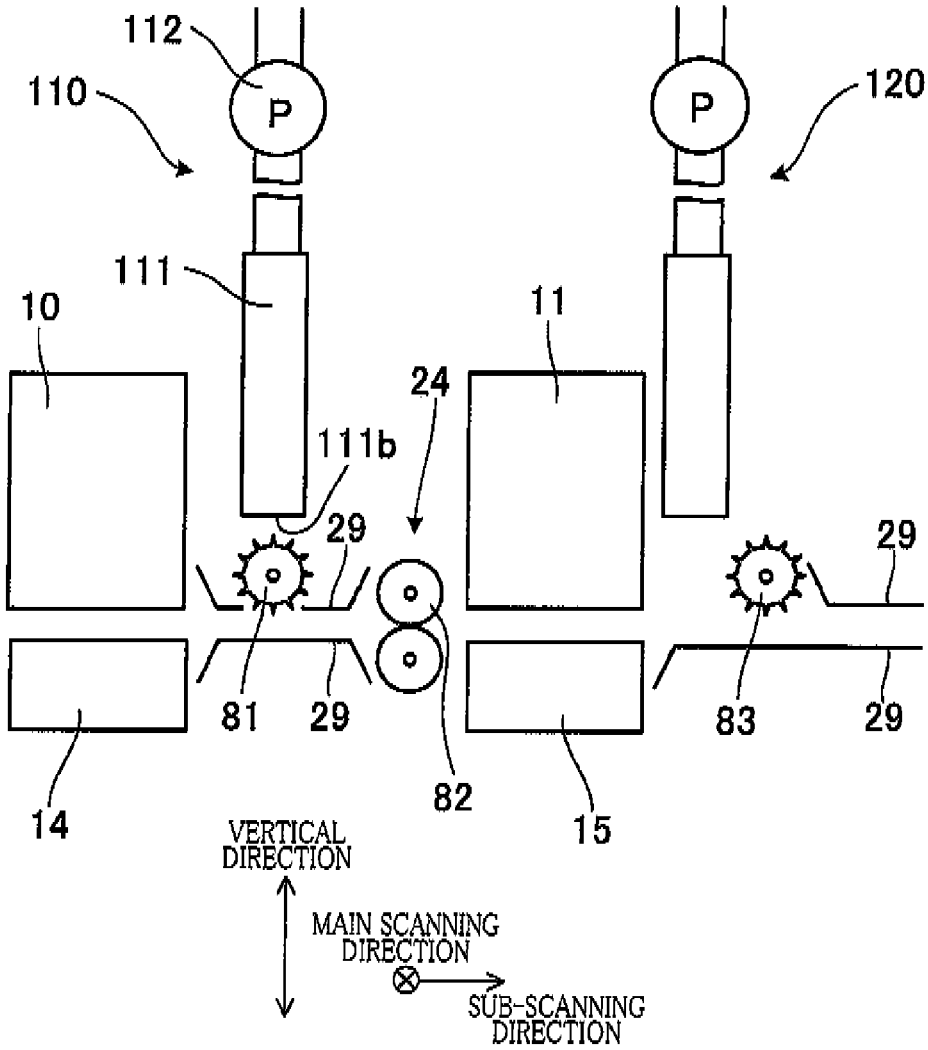
FIG. 5 is a front view of a modified embodiment to which the present invention is applied corresponding to FIG. 2.

In the illustrated embodiment, rollers (the spur roller 81 and the driven roller 82) are respectively located on the upstream side and the downstream side of the suction opening 111*b* of the duct 111 in the sub-scanning direction. However, an arrangement different from that in the illustrated embodiment may be adopted, as long as at least one of the spur roller 81 and the driven roller 82 and the suction opening 111*b* are located between the heads 10, 11 in the sub-scanning direction. For example, as shown in FIG. 5, the suction opening 111*b* may be located at the same position as the spur roller 81 in the sub-scanning direction. Further, only spur roller 81 may be located on the upstream side of the suction opening 111*b* in the sub-scanning direction, or only driven roller 82 may be located on the downstream side of the suction opening 111*b* in the sub-scanning direction. Furthermore, the driven roller 82 may consist of a spur roller similar to the spur roller 81.

In the illustrated embodiment, the lowermost point of the spur roller 81 in the vertical direction is located at the approximately same position as the conveying path of the recording sheet P in the vertical direction. However, a position of the spur roller 81 in the vertical direction may be located higher than that in the illustrated embodiment, as long as the lowermost point of the spur roller 81 in the vertical direction is closer to the conveying path of the recording sheet P than the suction opening 111*b*. It is similar to a positional relation between the spur roller 83 and the suction opening 121*b*.

Further, in the illustrated embodiment, one pre-coat head 10 and one inkjet head 11 are arranged in the sub-scanning direction. However, one pre-coat head 10 and two or more inkjet heads may be arranged in the sub-scanning direction. In this case, it is preferable that the pre-coat head 10 (as an example of a second head) is located on a most upstream portion among the heads (on an upstream side of the inkjet heads) in the sub-scanning direction and the suction mechanism 110 and the spur roller 81 are located between the pre-coat head 10 and the inkjet head (as an example of a first head) adjacent to the pre-coat head 10, Furthermore, without the pre-coat head 10, only a plurality of inkjet heads may be disposed. Between the inkjet heads adjacent to each other, the suction mechanism 110 and the spur roller 81 may be located or the suction mechanism 120 and the spur roller 83 may be located. In the illustrated embodiment, the platen 14 is located at the position opposite to the ejection face 10*a* of the head 10, while the platen 15 is located at the position opposite to the ejection face 11*a* of the head 11. As a modified example, one platen may be located to be opposed to the ejection face 10*a* of the head 10 and the ejection face 11*a* of the head 11. Moreover, though, in the illustrated embodiment, the spur roller 81, the driven roller 82 and the spur roller 83 have rotary members (the roller portions 81*b*, the driven roller 82 and the roller portions 83*b*), at least one of the spur roller 81, the driven roller 82 and the spur roller 83 may be a contact member which does not rotate but contacts the recording face of the recording sheet P. The contact member has a relatively small frictional resistance with the recording face of the recording sheet P and restrains the rising of the recording sheet P. This contact member restrains the rising of the recording sheet P, so that the recording sheet P can be restrained from contacting the ejection faces 10*a*, 11*a*.

The present invention is not limited to a printer, and is applicable to various liquid ejection apparatus, e.g., a facsimile machine, a copier machine, and so forth. A head may eject liquid other than the ink and the image-quality enhancing liquid.

What is claimed is:

1. A liquid ejection apparatus comprising:

a conveyor mechanism configured to convey a recording medium in a conveying direction;

a plurality of liquid ejection heads each of which has an ejection face from which a liquid is ejected and which are arranged in the conveying direction;

a support member opposed to at least one ejection face of the plurality of ejection faces and configured to support the recording medium;

a first suction mechanism having a first suction opening located between two of the plurality of liquid ejection heads adjacent to each other in the conveying direction, the first suction mechanism being configured to suck air via the first suction opening, wherein the first suction opening is located at a position higher than a support face of the support member, configured to support the recording medium, in a perpendicular direction perpendicular to the at least one ejection face; and at least one first contact member located between the two liquid ejection heads adjacent to each other in the conveying direction and configured to be contactable with a recording face of the recording medium at a position lower than the first suction opening in the perpendicular direction.

2. The liquid ejection apparatus according to claim 1, wherein the at least one first contact member is at least one first rotary member configured to be contactable with the recording face of the recording medium at the position closer to the support member than the first suction opening in the perpendicular direction.

3. The liquid ejection apparatus according to claim 2, wherein the first suction opening is located at a position farther from the support member than the ejection faces of the liquid ejection heads in the perpendicular direction, wherein the at least one first rotary member is located at a position closer to the support member than the ejection faces of the liquid ejection heads in the perpendicular direction.

4. The liquid ejection apparatus according to claim 2, wherein the at least one first rotary member is rotated by a contact thereof with the recording medium conveyed by the conveyor mechanism.

5. The liquid ejection apparatus according to claim 2, wherein the at least one first rotary member is located on an upstream side of the first suction opening in the conveying direction.

6. The liquid ejection apparatus according to claim 2, wherein the at least one first rotary member is a plurality of first rotary members and at least one of the plurality of first rotary members is located on an upstream side of the first suction opening in the conveying direction, while at least another of the plurality of first rotary members is located on a downstream side of the first suction opening in the conveying direction.

7. A liquid ejection apparatus comprising:

a conveyor mechanism configured to convey a recording medium in a conveying direction;

a plurality of liquid ejection heads each of which has an ejection face from which a liquid is ejected and which are arranged in the conveying direction;

a support member opposed to at least one ejection face of the plurality of ejection faces and configured to support the recording medium;

a first suction mechanism having a first suction opening located between two of the plurality of liquid ejection heads adjacent to each other in the conveying direction, the first suction mechanism being configured to suck air via the first suction opening; and at least one first contact member located between the two liquid ejection heads adjacent to each other in the conveying direction and configured to be contactable with a recording face of the recording medium at a position closer to the support member than the first suction opening in a perpendicular direction perpendicular to the at least one ejection face, wherein the at least one first contact member is at least one first rotary member configured to be contactable with the recording face of the recording medium at the position closer to the support member than the first suction opening in the perpendicular direction, wherein the at least one first rotary member is a plurality of first rotary members and at least one of the plurality of first rotary members is located on an upstream side of the first suction opening in the conveying direction, while at least another of the plurality of first rotary members is located on a downstream side of the first suction opening in the conveying direction, and wherein the conveyor mechanism includes a conveyor roller which is opposed to the at least one first rotary member located on the downstream side of the first suction opening in the conveying direction, and wherein the conveyor mechanism is configured to convey, in the conveying direction, the recording medium nipped between the at least one first rotary member and the conveyor roller.

8. The liquid ejection apparatus according to claim 1, wherein the plurality of liquid ejection heads include at least a first head configured to eject a liquid containing a specific component and a second head located on a most upstream side in the conveying direction among the plurality of liquid ejection heads and configured to eject an image-quality enhancing liquid which coagulates or precipitates the specific component, wherein the first suction opening and the first contact member are located between the second head and the first head adjacent to the second head in the conveying direction, and wherein the liquid ejection apparatus further comprising:

a second suction mechanism having a second suction opening located on a downstream side of the first head in the conveying direction and configured to suck air via the second suction opening; and at least one second contact member located on the downstream side of the first head in the conveying direction and configured to be contactable with the recording face of the recording medium at a position closer to the support member than the second suction opening in the perpendicular direction.

9. The liquid ejection apparatus according to claim 8, wherein the at least one second contact member is at least one second rotary member contactable with the recording face of the recording medium at the position closer to the support member than the second suction opening in the perpendicular direction.

10. The liquid ejection apparatus according to claim 9, wherein the second suction opening is located at a position farther from the support member than the ejection faces of the liquid ejection heads in the perpendicular direction, wherein the at least one second rotary member is located at a position closer to the support member than the ejection faces of the liquid ejection heads in the perpendicular direction.

11. The liquid ejection apparatus according to claim 9, wherein the second rotary member is rotated by a contact thereof with the recording medium conveyed by the conveyor mechanism.

12. The liquid ejection apparatus according to claim 9, wherein the at least one second rotary member is located on a downstream side of the second suction opening in the conveying direction, and wherein an amount of air that flows through the first suction opening in an airflow generated by the first suction mechanism is greater than an amount of air that flows through the second suction opening in an airflow generated by the second suction mechanism.

13. The liquid ejection apparatus according to claim 9, wherein a rotation axis of the at least one second rotary member extends in a direction along the at least one ejection face and perpendicular to the conveying direction.

14. The liquid ejection apparatus according to claim 2, wherein a rotation axis of the first rotary member extends in a direction along the at least one ejection face and perpendicular to the conveying direction.

15. The liquid ejection apparatus according to claim 2, wherein the first suction opening extends over the same range as the at least one first rotary member in a main scanning direction perpendicular to the conveying direction and the perpendicular direction, and is located at the same position as the at least one first rotary member in the conveying direction.

16. The liquid ejection apparatus according to claim 2, wherein the first suction opening extends over the same range as the at least one first rotary member in a main scanning direction perpendicular to the conveying direction and the perpendicular direction, and is located at a position different from the at least one first rotary member in the conveying direction.

17. The liquid ejection apparatus according to claim 9, wherein the second suction opening extends over the same range as the at least one second rotary member in a main scanning direction perpendicular to the conveying direction and the perpendicular direction, and is located at a position different from the at least one second rotary member in the conveying direction.

18. The liquid ejection apparatus according to claim 1, wherein the at least one first contact member is located between the first suction opening and the support member in the perpendicular direction.

19. The liquid ejection apparatus according to claim 1, wherein the lowest point of the at least one first contact member is located between the first suction opening and the support member in the perpendicular direction.

* * * * *